US005187319A

United States Patent [19]

Nouguez et al.

[11] Patent Number: 5,187,319

[45] Date of Patent: Feb. 16, 1993

[54] LOW VULNERABILITY COMPONENT OF EXPLOSIVE AMMUNITION AND PROCESS FOR INITIATING A CHARGE OF LOW-SENSITIVITY COMPOSITE EXPLOSIVE

[75] Inventors: Bruno Nouguez; Yves Bigot, both of Ballancourt; Jacky Groux, Fontenay Le Vicomte; Jean-Claude Derrien, Vert Le Petit, all of France

[73] Assignee: Societe Nationale Des Poudres et Explosifs, Paris Cedex, France

[21] Appl. No.: 922,666

[22] Filed: Aug. 5, 1992

Related U.S. Application Data

[63] Continuation of Ser. No. 757,034, Sep. 9, 1991, abandoned.

[30] Foreign Application Priority Data

Sep. 20, 1990 [FR] France ..... 90 11596

[51] Int. Cl.[5] ..... F42B 3/10; F42C 19/08

[52] U.S. Cl. ..... 102/202.1; 102/204; 102/205; 102/275.11; 102/305

[58] Field of Search ..... 102/202.1, 204, 205, 102/275.11, 305

[56] References Cited

U.S. PATENT DOCUMENTS

| | | | |
|---|---|---|---|
| 2,604,042 | 7/1952 | Cook | 102/701 |
| 2,921,521 | 1/1960 | La Haye et al. | 102/202 |
| 3,561,361 | 2/1971 | Kessenich et al. | 102/309 |
| 3,611,939 | 10/1971 | Stadler et al. | 102/204 |
| 5,034,072 | 7/1991 | Becuwe | 149/19.4 |
| 5,054,396 | 10/1991 | Grommes et al. | 102/204 |

FOREIGN PATENT DOCUMENTS

| | | |
|---|---|---|
| 1190855 | 6/1963 | Fed. Rep. of Germany . |
| 2280053 | 2/1976 | France . |
| 2561376 | 9/1985 | France . |
| 2575461 | 7/1986 | France . |
| 2584066 | 1/1987 | France . |

OTHER PUBLICATIONS

Tome 1 "Les explosifs" pp. 190–192 and 227–229.

Transport of dangerous Goods—testing criteria, second edition, published by the United Nations.

*Primary Examiner*—David H. Brown

*Attorney, Agent, or Firm*—Cushman, Darby & Cushman

[57] ABSTRACT

Low-vulnerability component of explosive ammunition and process for initiating a charge of low-sensitivity composite explosive. The subject of the present invention is a low-vulnerability component of explosive ammunition consisting of a preferably metallic enclosure 1 containing a charge 2 of low-sensitivity composite explosive E and, as initiating relay, a plane wave generator 3 consisting, on the one hand, of a cylindroconical cap 7 made of composite explosive A, the large base surface having a diameter d greater than the critical diameter of the explosive E, the cavity 8 of this cap 7 being filled with a composite explosive B and, on the other hand, of a reinforcer made of composite explosive C, of thickness e greater than 0.1 d, the detonation pressure of the explosive C being higher than that of the explosive E. The detonability index according to the test for detonability behind a barrier is between 90 and 200 cards in the case of the explosives A, B and C and lower than 90 cards in the case of the explosive E. The invention also relates to the process for initiating the charge 2 using the generator 3.

9 Claims, 1 Drawing Sheet

Figure 1:
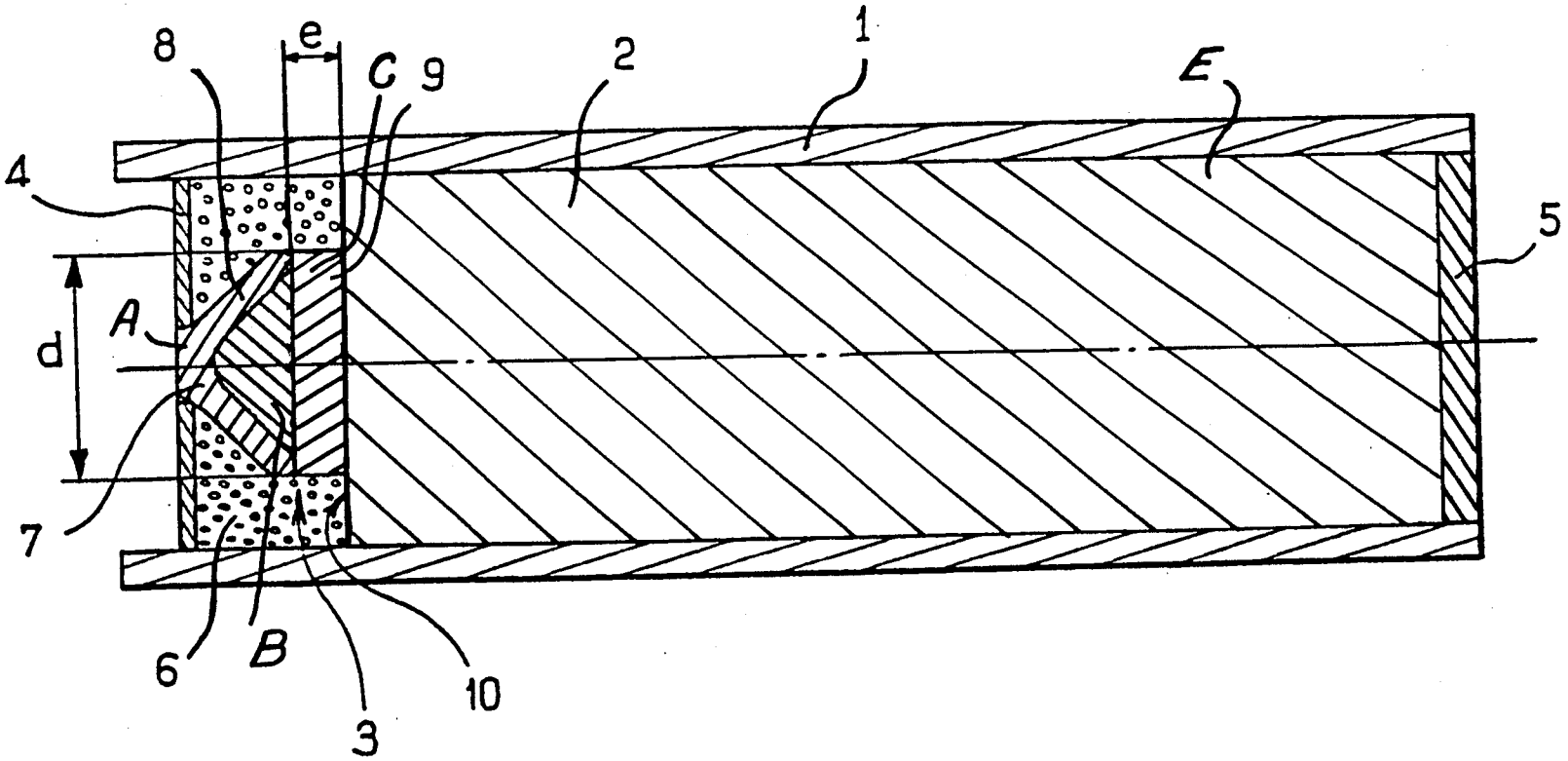

LOW VULNERABILITY COMPONENT OF EXPLOSIVE AMMUNITION AND PROCESS FOR INITIATING A CHARGE OF LOW-SENSITIVITY COMPOSITE EXPLOSIVE

This is a continuation of application No. 07/757,034, filed on Sep. 9, 1991, now abandoned.

The present invention relates to the field of ammunition with reduced risks. It relates to a low-vulnerability component of explosive ammunition, consisting of a generally metallic enclosure containing a low-sensitivity composite explosive charge and an initiation relay for this charge. It also relates to a process for detonating a charge of low-sensitivity composite explosive.

A composite explosive conventionally means an explosive composition containing a plastic binder fabricated by casting followed by polymerization and consisting of a filled plastic binder containing at least one organic nitrated explosive charge, for example hexogen, octogen or 5-oxo-3-nitro-1,2,4-triazole (ONTA).

The composite explosives and the way in which they are obtained are described, for example, by J. Quinchon, in Powders, propellants and explosives, volume 1: Explosives, Technique et Documentation, 1982, pages 190–192, and in FR 2,584,066.

Composite explosives in general and in comparison with wax-explosives, with mixtures based on tolite, such as hexolites, pentolites and octolites, and with explosives containing a plastic binder fabricated by compression, make it possible to decrease the vulnerability of ammunition from external attacks such as fire, impact and the entry of fragments or bullets, and the nearby detonation of neighboring ammunition.

While the problems linked with fire and with fragments can be solved in practice with the aid of conventional composite explosives, it has been possible to find only a partial solution to the problem of induced detonation, by the use of particularly low-sensitivity composite explosives such as those filled, for example, with ONTA, triaminotrinitrobenzene (TATB) or nitroguanidine.

A "low-sensitivity" composite explosive within the present invention is intended to mean a composite explosive which is currently referred to as "insensitive" by a person skilled in the art, having a degree of insensitivity corresponding to a detonability index (DI) according to the test for detonability behind a barrier (Card Gap Test) lower than 90 cards according to the codified test of 40 mm diameter or lower than 70 mm of polymethyl methacrylate (PMMA) according to the codified test of 75 mm diameter. These 2 codified tests of the Card Gap Test are well known to a person skilled in the art. They are described especially in the publication "Recommendations for the transport of dangerous materials. 2nd edition. ST/SG/AC 10/11 Rev. 1. UNO Publications, New York, 1990". Furthermore, J. Quinchon, in his work referred to above, describes the test of 40 mm diameter on pages 227 to 229.

The problem of induced detonation has been capable of only a partial solution insofar as the vulnerability of the explosive ammunition element is then dependent on that of the initiating relay. In fact, low-sensitivity composite explosives generally have a large critical diameter which may exceed 10 cm and have a fairly long transitional detonation regime when they are initiated by conventional initiating means. Such transitional regimes are unacceptable, especially in the military field, for example in the case of hollow charges. This problem of a transitional regime cannot be overcome by employing a conventional initiating relay of a large size, because the ammunition component would then be too vulnerable because of the size and of the sensitivity of the relay. Under these circumstances, in order better to understand the problem which arises and which the invention solves, it must furthermore be remembered that an initiating system generally consists of a detonator and one or more initiating relays, and that, while it is easily possible to disconnect the detonator and a small relay during storage and transport of an explosive ammunition so as to decrease the vulnerability of this ammunition, this becomes a considerable constraint when the relay is large.

To illustrate the abovementioned state of the art, French Patent FR 2,575,461 describes explosive 25 compositions of low sensitivity to external influences, which are initiated by large conventional relays and which are sensitive and vulnerable to a shock wave, made, for example, of pentolite.

Furthermore, Souletis and Groux, International Symposium on Pyrotechnics and Explosives, Beijing, China, 1987, have described the use of a plane wave generator made of explosive material for initiating composite explosives with a polyurethane binder filled with pentrite or octogen, which are sensitive and vulnerable to a shock wave.

The applicants have found that, unexpectedly, it was possible to initiate a composite explosive which was "insensitive" according to the abovementioned definition, using an initiating relay consisting of a plane wave generator of geometry, constitution and detonation characteristics which are well defined, the explosive charge and relay combination being found to be of low vulnerability to an external attack by a shock wave under storage conditions, whereas the constituents of the relay, taken in isolation, are relatively sensitive to this attack (detonability indices of between 90 and 200 cards in the Card Gap Test).

The subject matter of the present invention is a new explosive ammunition component. This component consists of an enclosure, preferably metallic, containing, on the one hand, a charge made of "insensitive" composite explosive E which has a detonability index, according to the Card Gap Test, lower than 90 cards or lower than 70 mm of polymethyl methacrylate and, on the other hand, a relay for initiating this charge, situated in contact with the latter. This contact may be more or less extensive, depending on the relative relay-charge position. The relay may be situated outside the charge or may be wholly or partially embedded in the charge.

The invention is characterised in that the initiating relay is a plane wave generator consisting, on the one hand, of a cylindroconical cap made of composite explosive A, the large base surface having a diameter d, the cavity of this cap being filled with a composite explosive B, and, on the other hand, a reinforcer made of composite explosive C, preferably cylindrical and of the same diameter d as that of the large base surface of the cylindroconical cap, of thickness e, extending the cap coaxially on the side of its large base surface as far as the charge, the composite explosives A, B and C having a detonability index of between 90 and 200 cards according to the Card Gap Test, or between 70 mm and 110 mm of polymethyl methacrylate, d being greater than the critical diameter $\phi cr$ of the composite explosive E forming the explosive charge, the thickness e of the reinforcer of the planar wave generator being greater than 0.1 d, preferably between 0.1 d and d, and the detonation pressure Pc of the composite explosive C being higher than the detonation pressure $P_E$, of the composite explosive E, preferably between 1.2 $P_E$ and 2 $P_E$.

According to the invention, the "cylindroconical" shape refers to any approximately conical or frustoconical shape which has two base surfaces of different diameter, optionally extended by a coaxial cylindrical part.

The critical diameter $\phi$cr of the composite explosive E is that measured without confinement, for example according to the method consisting in evaluating the largest diameter of a cylinder of explosive above which a continuous detonation can no longer propagate. To do this, a sample of explosive consisting of a series of coaxial cylinders of decreasing diameters is initiated by detonation at its larger end. The position where the detonation stops is marked on a lead detonation control plate, or with the aid of a probe. The length of each cylinder is equal to 4 times that of the diameter.

A detonation pressure conventionally means the pressure which appears at the front of the shock wave. This pressure is a constant for a given explosive. It is proportional to its density ($\tau$) and to the square of its detonation velocity (V). It is approximately equal to 0.25 $\tau V^2$. It can also be determined experimentally by methods which are well known to a person skilled in the art.

The composite explosive E is preferably a filled polyurethane plastic binder containing at least one explosive charge chosen from the group consisting of 5-oxo-3-nitro-1,2,4-triazole, triaminotrinitrobenzene, trinitroguanidine and mixtures thereof, and is preferably, 5-oxo-3-nitro-1,2-4-triazole. It may also contain other explosive charges, for example hexogen and/or octogen, and metal powder charges, for example, charge of aluminium and/or oxidising charges, for example ammonium perchlorate.

According to an alternative form the polyurethane binder is plasticized by an energetic plasticizer carrying at least one nitro or nitric ester group, for example nitroglycerine.

According to another alternative form of the invention at least one of the composite explosives A, B and C, preferably all three, consists of a filled polyurethane plastic binder containing at least one explosive charge chosen from the group consisting of octogen, hexogen, pentrite and mixtures thereof. According to this alternative form, the composite explosives A and C, which are identical or different, preferably consist of a polyurethane plastic binder filled with octogen and the composite explosive B consists of a polyurethane plastic binder filled with pentrite and red lead. The polyurethane plastic binder of composite explosives A, B and C is identical or different, preferably identical, and is preferably obtained by reacting a polyether containing hydroxyl ends with a polyisocyanate.

A further subject of the present invention is a process for detonating a charge of composite explosive E which has a detonability index according to the Card Gap Test lower than 90 cards or lower than 70 mm of polymethyl methacrylate by means of an initiating relay situated in contact with the charge. The process according to the invention is characterised in that the initiating relay is a plane wave generator consisting, on the one hand, of a cylindroconical cap made of composite explosive A, the large base surface having a diameter d, the cavity of this cap being filled with a composite explosive B, and, on the other hand, of a reinforcer made of composite explosive C, preferably cylindrical and with a diameter d, thickness e, extending the cap coaxially on the side of its large base surface as far as the charge, the composite explosives A, B and C having a detonability index according to the Card Gap Test of between 90 and 200 cards or between 70 mm and 110 mm of polymethyl methacrylate, d being greater than the critical diameter $\phi$cr of the composite explosive E, the thickness e of the reinforcer of the plane wave generator being greater than 0.1 d and the detonation pressure Pc of the composite explosive C being greater than the detonation pressure $P_E$ of the composite explosive E.

FIG. 1, attached, shows a diagrammatic section of a low-vulnerability component of explosive ammunition according to the invention, which has an axial symmetry.

In the embodiment shown diagrammatically in FIG. 1 the explosive ammunition component according to the invention consists of a metal enclosure 1 comprising a cylindrical part made of steel of 12.5 mm thickness and with an internal diameter of 90 mm, and a rear bottom 5 also made of steel of 12.5 mm thickness. This enclosure 1 contains a charge 2 made of composite explosive $E_1$ which has a detonability index of 25 cards according to the Card Gap Test as codified of 40 mm diameter and of 40 mm of polymethyl methacrylate according to the Card Gap Test as codified of 75 mm diameter. This composite explosive $E_1$ consists of 16% by weight of a polyurethane binder obtained by reacting a polybutadiene with hydroxyl end groups with isophorone diisocyanate (IPDI), 12% by weight of octogen and 72% by weight of ONTA. Its critical diameter $\phi$cr, without confinement, is between 65 and 70 mm and its detonation pressure is 22 GPa.

This charge 2 has a length of 400 mm and a diameter of 90 mm. It is in contact with the rear bottom 5 of the casing 1.

A plane wave generator 3, acting as an initiating relay for the charge 2, is present in contact with the surface 10 at the surface 10 of the charge 2 which is not in contact with the enclosure 1.

This plane wave generator 3 has an axial symmetry whose axis coincides with that of the casing 1 and of the charge 2. It consists of a cap 7 and a reinforcer 9.

A packing disc 4, made of plastic, 3 mm in thickness, 90 mm in diameter, provided with a concentric circular opening 20 mm in diameter, enables the centring of the plane wave generator 3 in the casing 1 to be maintained. This packing disc can also be made of metal or of any other rigid material.

The cap 7 is made of composite explosive $A_1$ consisting of 14% by weight of a polyurethane binder obtained by reacting a polyether with hydroxyl ends with isophorone diisocyanate, and 86% by weight of octogen. This composite explosive $A_1$ has a detonability index of 150 cards in the Card Gap Test of 40 mm diameter.

The cap 7 is approximately cylindrofrustoconical, the generatrix of the conical frustum forming an angle of 57° with the axis. The diameter of the large base surface is d=76 mm and that of the small base surface 20 mm. Its thickness is approximately 7 mm. The end which has the smaller diameter is extended by a coaxial cylindrical part of the same diameter of 20 mm, 3 mm in thickness, fitting into the circular opening of the packing disc 4, The end which has the larger diameter is extended by a coaxial cylindrical crown ring of the same diameter of 76 mm, approximately 5 mm in height.

The cavity 8 of this cap 7 is filled with a composite explosive $B_1$ consisting of 11.5% by weight of a polyurethane binder obtained by reacting a polyether with hydroxyl ends with isophorone diisocyanate, 17% by weight of pentrite and 71.5% of red lead. This composite explosive $B_1$ has a detonability index of 190 cards in the Card Gap Test of 40 mm diameter.

The reinforcer 9 is a cylinder with a diameter d=76 mm extending the cap 7 coaxially on the side of its large base surface as far as the surface 10 of the charge 2. Its thickness e is 30 mm. This reinforcer 9 is a composite explosive $C_1$ consisting of 14% by weight of a polyurethane binder obtained by a reacting a polyether containing hydroxyl ends with isophorone diisocyanate, and 86% by weight of octogen. This composite explosive C has a detonability index of 150 cards in the Card Gap Test of 40 mm diameter, and a detonation pressure of 30 GPa.

The plane wave generator 3, with a mass of 390 g, was produced according to conventional technology which is wellknown to the specialist in the field of the moulding of multicomponent composite explosives.

The free space bounded by the surface 10 of the charge 2, the plane wave generator 3, the packing disc 4 and the cylindrical part of the enclosure 1 is occupied by an inert, preferably resilient, material which makes it possible, in combination with the disc 4, to pack the plane wave generator 3. It may also be occupied by an insensitive composite explosive, preferably that forming the charge 2, which increases the power per unit volume of the explosive ammunition element and makes it possible to do away with the packing disc 4.

The initiation of the charge 2 was carried out with the aid of a Davey Bickford SA4000 detonator and a small relay of 4 g mass placed in contact with the planar wave generator 3 at the cylindrical part fitting into the circular opening in the packing disc 4. This small relay is a composite explosive consisting of 16% by weight of a polyurethane binder obtained by reacting a polyether containing hydroxyl end groups with isophorone diisocyanate, 44% by weight of pentrite and 40% by weight of octogen. A small relay of 4 g of hexowax could also be employed.

A nominal detonation regime with a velocity of 7440 m/s was obtained with a small transitional regime, lower than 90 mm.

A stack of 9 explosive ammunition components identical with that referred to above was also produced. This stack consists of 3 superposed rows of 3 components, each component being separated from neighboring components by a 25 mm space. One of the two peripheral components of the lower row was then initiated, as in the preceding test. The nominal detonation of this component has not resulted in the detonation of the other components. This absence of induced detonation shows the low vulnerability of the explosive ammunition components according to the invention, despite the presence, in these ammunition components, of relatively sensitive composite explosives $A_1$, $B_1$ and $C_1$ (detonability indices of 150 and 190 cards).

In order to give a better demonstration of the merit and the advantages of the ammunition components according to the invention, the following two comparative tests which do not come within the scope of the present invention were carried out.

According to comparative test 1, the explosive ammunition component differs from that referred to above according to the invention only in the fact that the composite explosive forming the reinforcer 9 of the plane wave generator 3 has a detonation pressure of 20 GPa, lower than that of the composite explosive $E_1$ (22 GPa) forming the charge 2.

Under these conditions the desired nominal initiation of the charge 2 (7440 m/s) was not obtained, but a mean detonation velocity of 5000 m/s, corresponding to a transitional regime over the whole length of the charge.

According to comparative test 2, 9 explosive ammunition components were produced, differing from the abovementioned components according to the invention only in the fact that the composite explosive forming the charge is the composite explosive $C_1$ forming the reinforcer 9 of the plane wave generator 3, and then the same stack firing test as that described previously. An induced detonation of the complete stack is observed in this case.

This comparative test 2 clearly shows the unexpected nature of the absence of induced detonation of the explosive ammunition components according to the invention, since these nevertheless contain the same composite explosive C and the composite explosives A and $B_1$ of sensitivity equal to or higher than that of $C_1$, in large quantity (390 g in all).

We claim:

1. An explosive ammunition component comprising an enclosure containing a composite explosive charge E having a detonability index lower than 90 cards as measured by the Card Gap Test and an initiating relay for said charge, said initiating relay comprising a plane wave generator having the form of a cylindroconical cap having a cavity, said cap being made of a composite explosive A and having a first base of diameter d and a second, oppositely located base of a diameter smaller than said first base, said cavity being filled with a composite explosive B, said enclosure having opposite ends and said cap being disposed with said second base at one of said ends, a reinforcer disposed adjacent said first base of said cap, said reinforcer having a thickness e and being composed of a composite explosive C, said reinforcer being disposed between said first base of said cap and said charge E, said composite explosives A, B and C having a detonability index of between 90 and 200 cards, said composite explosive E having a critical diameter and said diameter d being greater than said critical diameter, said thickness e of said reinforcer being greater than 0.1 d, said composite explosives C and E being capable of generating detonation pressures $P_c$ and $P_e$, respectively, and said detonation pressure $P_c$ being greater than the detonation pressure $P_e$ of said composite explosive E.

2. The ammunition component as claimed in claim 1, wherein said enclosure is metallic.

3. Explosive ammunition component according to claim 1, characterised in that the composite explosive E is a filled polyurethane plastic binder containing at least one explosive charge chosen from the group consisting of 5-oxo-3-nitro-1,2-4-triazole, triaminotrinitrobenzene, nitroguanidine and mixtures thereof, including 5-oxo-3-nitro-1,2,4-triazole.

4. Explosive ammunition component according to claim 1 or 3, characterised in that the thickness e of the reinforcer (9) is between 0.1 d and d.

5. Explosive ammunition component according to claim 1 or 3, characterised in that the pressure Pc is between 1.2 $P_E$ and 2 $P_E$.

6. Explosive ammunition component according to claims 1 or 3, characterised in that at least one of the composite explosives A, B and C, consists of a filled polyurethane plastic binder containing at least one explosive charge chosen from the group consisting of octogen, hexogen, pentrite and mixtures thereof.

7. Ammunition component according to any claim 1 or 3, characterised in that the composite explosives A and C, comprises a polyurethane plastic binder filled with octogen and in that the composite explosive B comprises a polyurethane plastic binder filled with pentrite and red lead.

8. Ammunition component according to claim 7, characterised in that the polyurethane plastic binder of the composite explosives A, B and C is identical and is obtained by reacting a polyether containing hydroxyl ends with a polyisocyanate.

9. A process for detonating an explosive ammunition component comprising the step of using a component of the type having an enclosure containing a composite explosive charge E having a detonability index lower than 90 cards as measured by the Card Gap Test and an initiating relay for said charge, said initiating relay comprising a plane wave generator having the form of a cylindroconical cap having a cavity, said cap being made of a composite explosive A and having a first base of diameter d and a second, oppositely located base of a diameter smaller than said first base, said cavity being filled with a composite explosive B, said enclosure having opposite ends and said cap being disposed with said second base at one of said ends, a reinforcer disposed adjacent said first base of said cap, said reinforcer having a thickness e and being composed of a composite explosive C, said reinforcer being disposed between said first base of said cap and said charge E, said composite explosives A, B and C having a detonability index of between 90 and 200 cards, said composite explosive E having a critical diameter and said diameter d being greater than said critical diameter, said thickness e of said reinforcer being greater than 0.1 d, said composite explosives C and E being capable of generating detonation pressures $P_c$ and $P_e$, respectively, and said detonation pressure $P_c$ being greater than the detonation pressure $P_e$ of said composite explosive E.

* * * * *